US007449836B2

(12) United States Patent
Yi et al.

(10) Patent No.: US 7,449,836 B2
(45) Date of Patent: Nov. 11, 2008

(54) PLASMA DISPLAY PANEL (PDP) HAVING FIRST, SECOND, THIRD AND ADDRESS ELECTRODES

(75) Inventors: Jeong-Doo Yi, Suwon-si (KR); Jeong-Nam Kim, Suwon-si (KR); Byoung-Min Chun, Suwon-si (KR); Tae-Woo Kim, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 11/150,148

(22) Filed: Jun. 13, 2005

(65) Prior Publication Data

US 2006/0001378 A1 Jan. 5, 2006

(30) Foreign Application Priority Data

Jun. 30, 2004 (KR) ..... 10-2004-0050879

(51) Int. Cl.
*H01J 17/49* (2006.01)

(52) U.S. Cl. ..... 313/587; 313/582; 313/583; 313/586; 315/169.1

(58) Field of Classification Search ..... 313/582–587; 315/169.1

See application file for complete search history.

(56) References Cited

U.S. PATENT DOCUMENTS 5,541,618 A 7/1996 Shinoda
5,661,500 A 8/1997 Shinoda et al.
5,663,741 A 9/1997 Kanazawa
5,674,553 A 10/1997 Shinoda et al.
5,724,054 A 3/1998 Shinoda
5,744,909 A * 4/1998 Amano ..... 313/585
5,786,794 A 7/1998 Kishi et al.

(Continued)

FOREIGN PATENT DOCUMENTS

EP 1146539 A2 * 10/2001

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Toan Ton
*Assistant Examiner*—Hana A Sanei
(74) *Attorney, Agent, or Firm*—Robert E. Bushnell, Esq.

(57) ABSTRACT

A plasma display panel (PDP) having improved light emission efficiency by minimizing blockage of emitted visible light rays includes: a first substrate and a second substrate arranged opposite to each other; a plurality of barrier ribs arranged between the first and second substrates to define two sides of closed discharge cells; first electrodes and second electrodes arranged to extend in a direction intersecting the barrier ribs to define two other sides of the closed discharge cells and alternately arranged between the discharge cells defined consecutively; phosphor layers each arranged in the discharge cells partitioned by the barrier ribs and the first and second electrodes; address electrodes arranged on the second substrate; and third electrodes arranged on the first substrate to extend in a direction intersecting the address electrodes.

14 Claims, 5 Drawing Sheets

U.S. PATENT DOCUMENTS

| | | | | |
|---|---|---|---|---|
| 5,883,462 | A * | 3/1999 | Ushifusa et al. | 313/292 |
| 5,952,782 | A | 9/1999 | Nanto et al. | |
| 6,211,614 | B1 * | 4/2001 | Katayama et al. | 313/582 |
| RE37,444 | E | 11/2001 | Kanazawa | |
| 6,630,916 | B1 | 10/2003 | Shinoda | |
| 6,696,787 | B2 * | 2/2004 | Akiba | 313/582 |
| 6,707,436 | B2 | 3/2004 | Setoguchi et al. | |
| 2002/0135545 | A1 * | 9/2002 | Akiba | 345/60 |

FOREIGN PATENT DOCUMENTS

| | | | |
|---|---|---|---|
| JP | 02-148645 | | 6/1990 |
| JP | 04-160732 | | 6/1992 |
| JP | 10-199427 | | 7/1998 |
| JP | 2845183 | | 10/1998 |
| JP | 2917279 | | 4/1999 |
| JP | 2000133144 | A * | 5/2000 |
| JP | 2000331615 | A * | 11/2000 |
| JP | 2001-043804 | | 2/2001 |
| JP | 2001-325888 | | 11/2001 |
| JP | 2003-338246 | | 11/2003 |
| JP | 2004-241379 | | 8/2004 |

* cited by examiner

PLASMA DISPLAY PANEL (PDP) HAVING FIRST, SECOND, THIRD AND ADDRESS ELECTRODES

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on 30 Jun. 2004 and there duly assigned Ser. No. 10-2004-0050879.

BACKGROUND OF THE INVENTION

1. Field of the Invention

The present invention relates to a Plasma Display Panel (PDP) and, more particularly, to a PDP having improved light emission efficiency.

2. Description of the Related Art

In general, a PDP is a light-emitting device for displaying an image using a gas discharge. The PDP provides excellent display capabilities in terms of display capacity, brightness, contrast, image retention, and viewing angle, such that it is becoming popular as a substitute for a CRT. A DC or AC voltage is supplied to electrodes to generate a gas discharge between the electrodes to emit ultraviolet (UV) light rays, and the UV light rays excite phosphor materials to generate visible light rays.

An AC PDP includes front and rear substrates which are bonded together to form an integrated body and are separated from each other by barrier ribs interposed therebetween. The front substrate includes X-electrodes and Y-electrodes which are sustain discharge electrodes. The rear substrate includes address electrodes. The barrier ribs have a phosphor layer formed thereon. Discharge cells partitioned by the barrier ribs disposed between the two substrates are filled with an inert gas such as Ne—Xe.

When an addressing voltage and a scan pulse are supplied to the address electrode and the Y-electrode, respectively, an address discharge occurs between the two electrodes so that a discharge cell is selected. Wall charges are formed within the selected discharge cell.

Subsequently, when a sustain discharge voltage is supplied to the X- and Y-electrodes, electrons and ions formed on the X- and Y-electrodes migrate between the X- and Y-electrodes. The sustain discharge voltage is added to a wall voltage formed by the wall charge to exceed a discharge initiation voltage. As a result, a sustain discharge occurs in the discharge cell.

During a sustain discharge period, UV light rays impinge on a phosphor layer in the discharge cell to create visible light rays, whereby each pixel formed in the discharge cell forms an image.

That is, the PDP is a three-electrode PDP where X- and Y-electrodes are provided on the front substrates of the discharge cell and an address electrode is provided on the middle of the rear substrate of the discharge cell intersecting the X- and Y-electrodes.

Accordingly, the three-electrode PDP has a poor light-emitting efficiency since the distance between the X- and Y-electrodes is kept short. Furthermore, since the X- and Y-electrodes are provided on the front substrate, a surface discharge is difficult and visible light rays emitted from the discharge cells are blocked, thereby decreasing the light emission efficiency.

SUMMARY OF THE INVENTION

The present invention provides a Plasma Display Panel (PDP) capable of facilitating a discharge and improving the light emission efficiency by minimizing the blockage of emitted visible light rays.

In accordance with an aspect of the present invention, a Plasma Display Panel (PDP) is provided comprising: a first substrate and a second substrate arranged opposite to each other; a plurality of barrier ribs arranged between the first and second substrates to define two sides of closed discharge cells; first electrodes and second electrodes arranged to extend in a direction intersecting the barrier ribs to define two other sides of each of the discharge cells and alternately arranged between the discharge cells consecutively defined; phosphor layers each arranged in the discharge cells defined by the barrier ribs and the first and second electrodes; address electrodes arranged on the second substrate; and third electrodes arranged on the first substrate to extend in a direction intersecting the address electrodes.

The discharge cells are preferably rectangular in shape.

The first and second electrodes are preferably arranged to act on all of the discharge cells adjacent to the address electrode in the extending direction thereof.

The first, second and third electrodes are preferably arranged between the first and second substrates in a repeating order of first electrode—third electrode—second electrode—third electrode—first electrode.

The first and second electrodes are preferably strip shaped, and are preferably opposite to each other on two sides of each of the discharge cells in the extending direction of the address electrodes.

The first and second electrodes preferably comprise a metallic material having an excellent electrical conductivity.

The first and second electrodes preferably have a dielectric layer on both sides of the address electrodes in the extending direction of the address electrodes.

The dielectric layer is preferably covered with a phosphor layer.

The third electrode preferably includes a transparent electrode arranged on the first substrate between the first and second electrodes and extending parallel to the first and second electrodes, and a bus electrode arranged on the transparent electrode and extending in the same direction as the transparent electrode.

The bus electrode preferably has a width narrower than that of the transparent electrode.

The third electrode is preferably covered with a dielectric layer and a MgO protective film.

The discharge cells are preferably rectangular in shape; the first electrodes are preferably separately arranged on both sides of a first barrier rib interposed therebetween; and the second electrodes are preferably separately arranged on both sides of a second barrier rib interposed therebetween.

The first electrodes are preferably arranged between the first and second substrates to have the same height as the first barrier rib; and the second electrodes are preferably arranged between the first and second substrates to have the same height as the second barrier rib.

The first electrodes and second electrodes are preferably covered with a dielectric layer.

The first electrodes are preferably arranged between the first and second substrates to be lower in height than the first barrier rib, and the second electrodes are preferably arranged between the first and second substrates to be lower in height than the second barrier rib.

The first and second electrodes are preferably arranged in the center of the discharge cells between the first and second substrates in the height direction of the discharge cells.

The first electrodes lower in height than the first barrier rib and a portion of the first barrier rib not covered by the first electrodes and the second electrodes lower in height than the second barrier rib and a portion of the second barrier rib not covered by the second electrodes are preferably covered with a dielectric layer.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DESCRIPTION OF THE INVENTION

Figure 1:
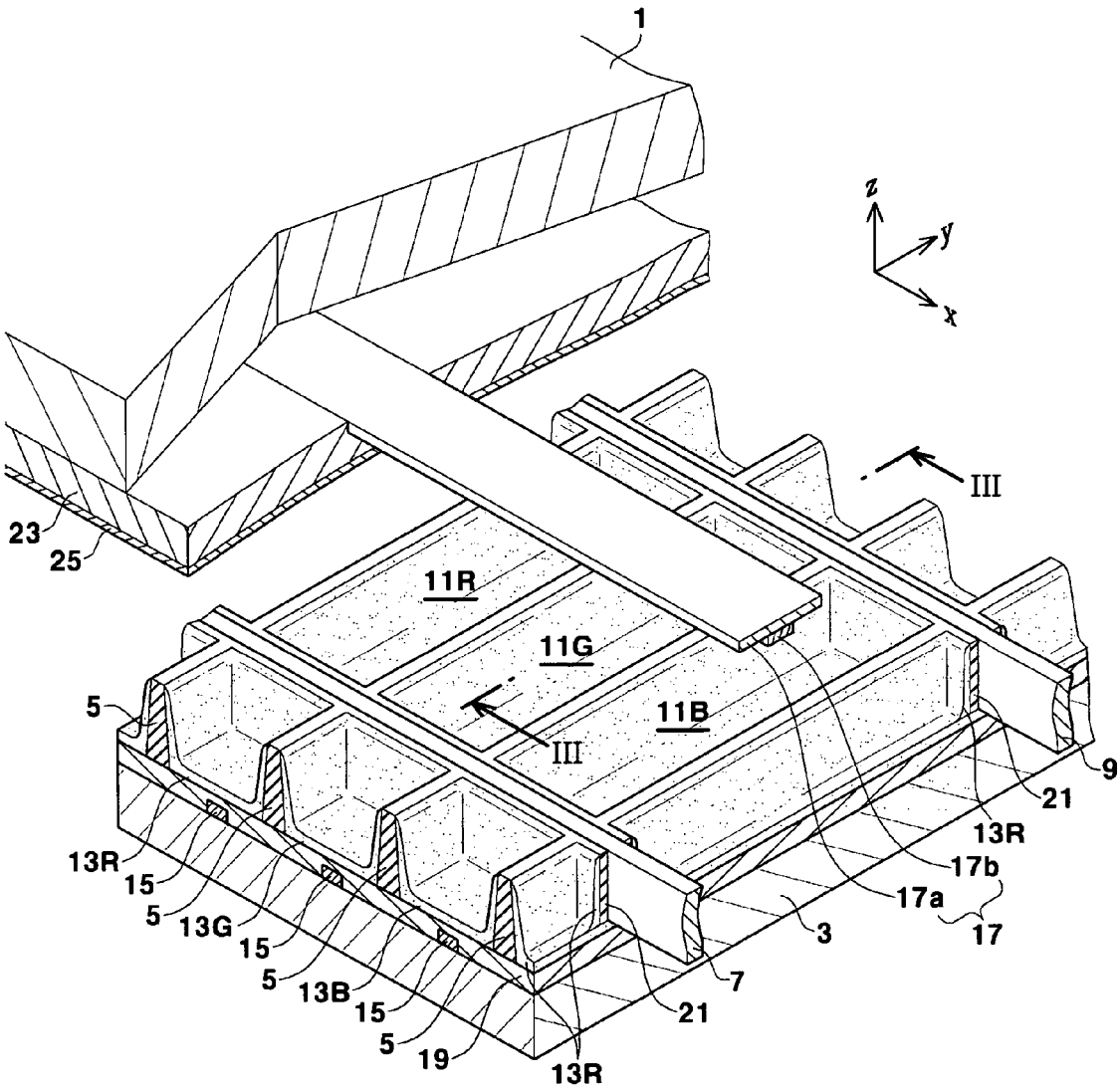
FIG. 1 is a partially exploded perspective view of a PDP in accordance with a first embodiment of the present invention.

Hereinafter, exemplary embodiments of the present invention are described below in more detail with reference to the accompanying drawings where like reference numerals refer to like elements.

FIG. 1 is a partially exploded perspective view of a PDP in accordance with a first embodiment of the present invention.

Referring to FIG. 1, a PDP according to the first embodiment includes a first substrate 1 (hereinafter referred to as "front substrate") and a second substrate 3 (hereinafter referred to as "rear substrate") which are bonded together to form an integrated body, opposed to and separated from each other by a predetermined distance.

A plurality of barrier ribs 5, and first electrodes 7 and second electrodes 9, which are alternately arranged in a direction intersecting the barrier ribs 5, are provided between the front substrate 1 and the rear substrate 3, thereby forming closed discharge cells 11R, 11G, 11B. The discharge cells 11R, 11G, 11B include phosphor layers 13R, 13G, 13B respectively formed of phosphor materials of Red (R), Green (G), and Blue (B) primary colors. The phosphor layers 13R, 13G, 13B are excited by ultraviolet light rays emitted by a plasma discharge to emit visible light rays.

Address electrodes 15 extend on the rear substrate 3 and third electrodes 17 (hereinafter referred to as "M-electrodes") extend on the front substrate 1 in a direction intersecting the address electrodes 15.

As described above, the discharge cells 11R, 11G, 11B are formed as closed structures by the barrier ribs 5 which extend in the longitudinal direction (y-axis direction) of the address electrode 15 and are arranged to be parallel to each other, and by X-electrodes 7 and Y-electrodes 9 which extend in the direction (x-axis direction) intersecting the barrier ribs 5 and are arranged to be parallel to each other. As shown in FIG. 1, the barrier ribs 5 and X- and Y-electrodes 7 and 9 intersect each other at right angles, so that the discharge cells 11R, 11G, 11B have a rectangular shape. The barrier ribs 5 extend in y-axis direction and are arranged along the x-axis direction in outer parts of the discharge cells 11R, 11G, 11B. The X- and Y-electrodes 7 and 9 extend in the x-axis direction and are alternately arranged along the y-axis direction in outer parts of the discharge cells 11R, 11G, 11B. When the X- and Y-electrodes 7 and 9 extend in the x-axis direction, the discharge cells 11R, 11G, 11B can be formed in various shapes, such as rectangle, hexagon, or octagon, depending on the shapes of the barrier ribs 5.

Figure 2:
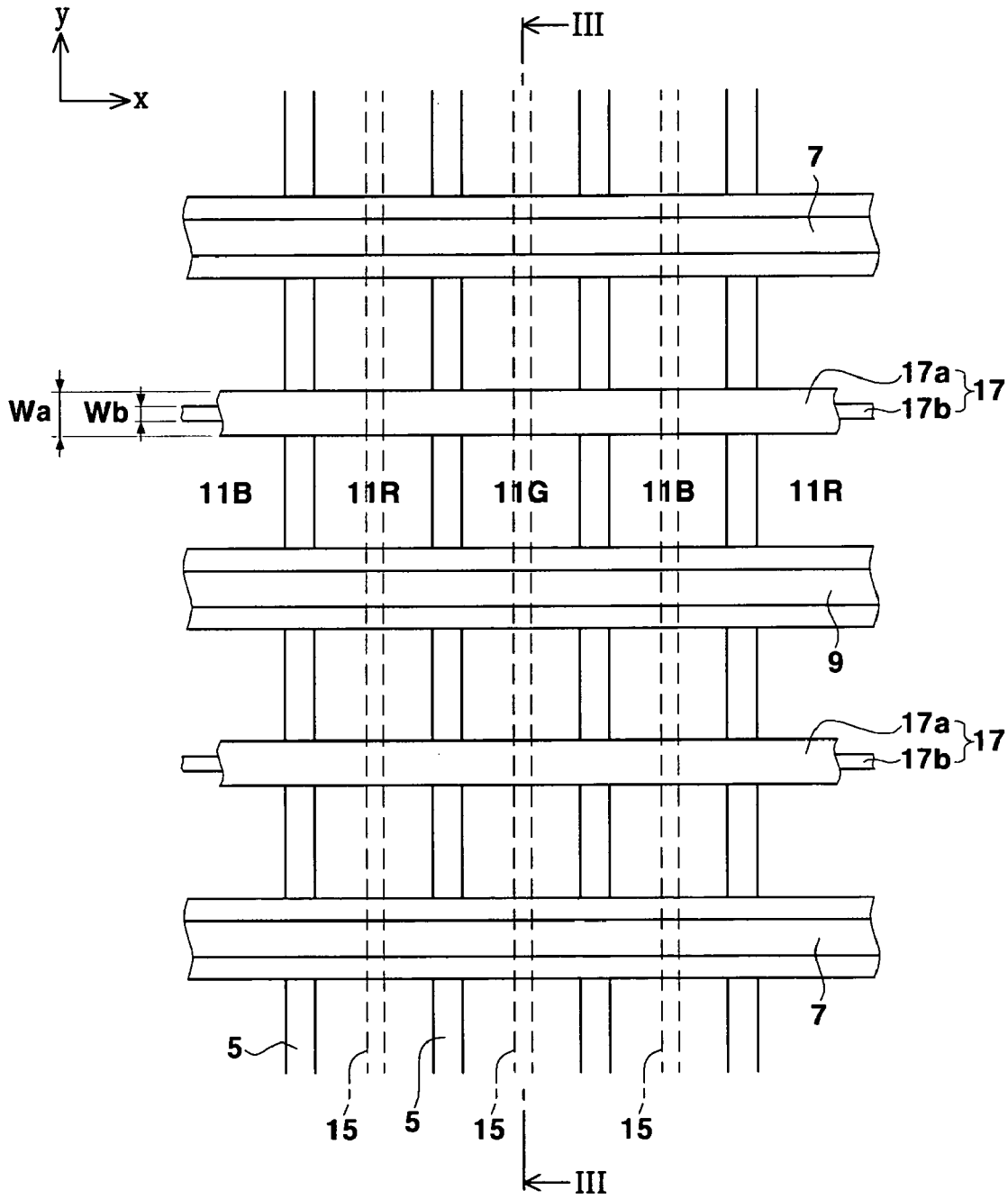
FIG. 2 is a top plan view of FIG. 1.

FIG. 2 is a top plan view of FIG. 1.

Referring to FIG. 2, the barrier ribs 5 have a predetermined height (in the z-axis direction of FIG. 2) on a dielectric layer 19 of the rear substrate 3. The height of the barrier rib 5 defines a gap between the front substrate 1 and the rear substrate 3. The X- and Y-electrodes 7 and 9 extend in the x-axis direction and the barrier ribs 5 are arranged to extend in the y-axis direction between the X- and Y-electrodes 7 and 9. That is, the barrier ribs 5 are divided by the X- and Y-electrodes 7 and 9 in the y-axis direction of the discharge cells 11R, 11G, 11B.

The address electrodes 15 extend in the direction intersecting X-, Y-, and M-electrodes 7, 9, and 17 (i.e. in the y-axis direction of FIG. 2) on the rear substrate 3 and are covered by the dielectric layer 19. The address electrodes 15 are preferably arranged in the center of the discharge cells 11R, 11G, 11B so that an address discharge occurs during a scan period by interacting with the M electrodes 17 in the center of the discharge cells 11R, 11G, 11B.

When an addressing voltage is supplied to the address electrodes 15 and a scan pulse is supplied to the M-electrodes 17, an address discharge occurs within the discharge cells 11R, 11G, 11B between two selected electrodes and discharge cells 11R, 11G, 11B are selected, so that wall charges are formed within the selected discharge cells 11R, 11G, 11B.

The X- and Y-electrodes 7 and 9 intersecting the address electrodes 15 are opposed to each other on both sides of the discharge cells 11R, 11G, 11B. During a reset period, a reset discharge occurs due to a rising reset waveform and a falling reset waveform supplied to the M-electrodes 17. During a scan period subsequent to the reset period, as described above, an address discharge occurs due to a scan pulse waveform supplied to the M-electrodes 17 and a pulse waveform supplied to the address electrode 15. Subsequently, during a sustain period, a sustain discharge occurs due to a sustain voltage supplied to the X- and Y-electrodes 7 and 9. As a result, an image is displayed on the PDP.

The X- and Y-electrodes 7 and 9 are arranged to act on all of the discharge cells 11R, 11G, 11B adjacent to the address electrodes 15 in the longitudinal direction. The M-electrodes 17 are formed on the front substrate 1 to be between the X- and Y-electrodes 7 and 9. That is, between the front substrate 1 and the rear substrate 3, the X-, Y-, and M-electrodes 7, 9, and 17 are arranged in the repeating order of X-M-Y-M-X, . . . , Y-M-X-M-Y. That is, the X- and Y-electrodes 7 and 9 are alternately arranged, and the M-electrodes 17 are provided between the X- and Y-electrodes 7 and 9, and between the Y- and X-electrodes 9 and 7, respectively.

Figure 3:
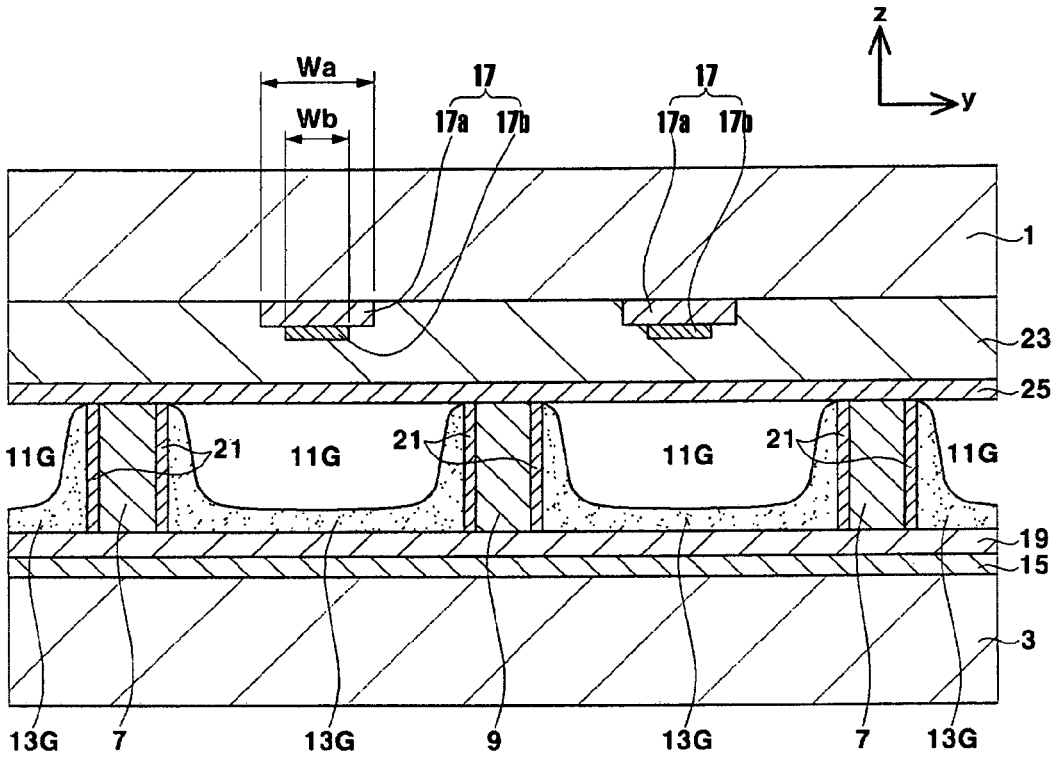
FIG. 3 is a cross-sectional view taken along the line III-III of FIG. 1.

FIG. 3 is a cross-sectional view taken along the line III-III of FIG. 1.

Referring to FIG. 3, the X- and Y-electrodes 7 and 9 are provided on the dielectric layer 19 to form both sides of the y-axis direction of the discharge cells 11R, 11G, 11B while intersecting the address electrodes 5, and are then covered by a dielectric layer 21. The dielectric layer 21 accumulates wall charges when the X- and Y-electrodes 7 and 9 generate an opposing discharge. The phosphor layers 13R, 13G, 13B are formed on the dielectric layer 21. Accordingly, the phosphor layers 13R, 13G, 13B are formed on the dielectric layer 19 of the rear substrate 3, inner lateral surfaces of the barrier ribs 5, and inner lateral surfaces of the dielectric layer 21 covering the X- and Y-electrodes 7 and 9. The X- and Y-electrodes 7 and 9 are formed to have a predetermined height in the z-axis direction of FIG. 1 and extend in the x-axis direction. Furthermore, the X- and Y-electrodes 7 and 9 are arranged parallel to each other on both sides of the discharge cells 11R, 11G, 11B in a longitudinal direction (y-axis direction) of the address electrode 15. Thus, the above structure of X- and Y-electrodes 7 and 9 enables an opposing discharge, thereby facilitating an improved discharge as compared to a surface discharge.

The X- and Y-electrodes 7 and 9 are provided to effect a sustain discharge commonly to adjacent discharge cells 11R, 11G, 11B to eliminate a non-discharge area formed between the adjacent discharge cells 11R, 11G 11B. Accordingly, a discharge area is increased, thereby increasing the discharge efficiency.

Also, the X- and Y-electrodes 7 and 9 are provided in non-discharge areas forming peripheral parts of the discharge cells 11R, 11G, 11B. Thus, since visible light rays emitted from the discharge cells 11R, 11G, 11B are not blocked, the X- and Y-electrodes 7 and 9 can be made of non-transparent material and are preferably made of a metallic material such as aluminum that has high electrical conductivity.

The M-electrode 17 interacts with the address electrode 15 during a scan period (i.e. a scan pulse is supplied to the M-electrode 17 and an addressing voltage is supplied to the address electrode 15) to generate an address discharge and to select the discharge cells 11R, 11G, 11B.

In the present embodiment, the X- and Y-electrodes 7 and 9 act to supply the voltage required for a sustain discharge, and the M-electrode 17 acts to supply scan and reset pulse waveforms. However, the X-, Y-, and M-electrodes 7, 9, and 17 can act differently according to the voltage waveforms supplied to each of them.

While the M-electrode 17 can be formed of either a transparent electrode 17*a* or a bus electrode 17*b*, the M-electrode 17 is formed of both the transparent electrode 17*a* and the bus electrode 17*b* in the present embodiment. The transparent electrode 17*a*, together with the address electrode 15, acts to generate an address discharge inside the discharge cells 11R, 11G, 11B, and can be formed of a transparent Indium Tin Oxide (ITO) to ensure a high aperture ratio. The bus electrode 17*b* acts to ensure a high electrical conductivity by compensating for a high electrical resistance of the transparent electrode 17*a*, and can be formed of a metallic material such as aluminum. Also, preferably, the bus electrode 17*b* is provided in the center of the discharge cells 11R, 11G, 11B and has a narrower width Wb than a width Wa of the transparent electrode 17*a* so that blockage of visible light rays can be minimized. The M-electrode 17 is covered with a dielectric layer 23 for accumulating wall charges and a MgO protective layer 25 for protecting the dielectric layer 23 and for increasing the emission of secondary electrons.

Figure 4:
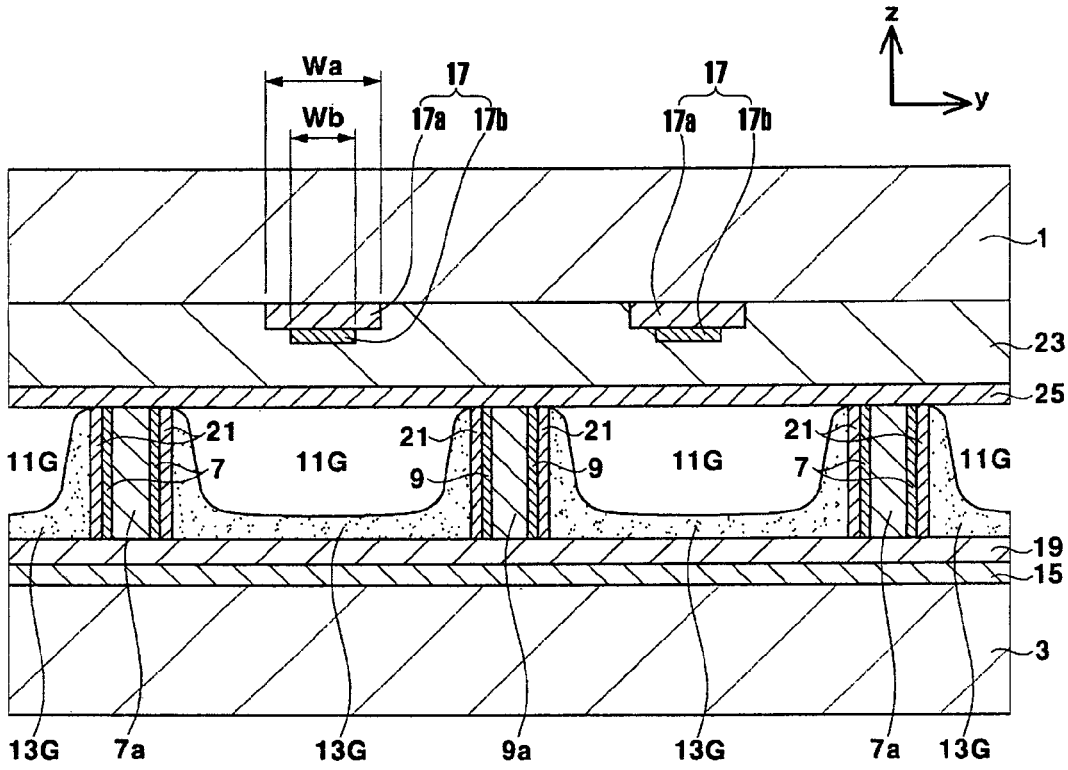
FIG. 4 is a cross-sectional view of a PDP in accordance with a second embodiment of the present invention.

FIG. 4 is a cross-sectional view of a PDP in accordance with a second embodiment of the present invention.

Referring to FIG. 4, the construction of the second embodiment is the same or similar to that of the first embodiment. Thus, only a detailed description of different parts between the first and second embodiments is provided below.

In the first embodiment, the X- and Y-electrodes 7 and 9 form both sides of the discharge cells 11R, 11G, 11B in the longitudinal direction (y-axis direction) of the address electrode 15. On the other hand, in the second embodiment, the X-electrodes 7 are separately formed on both sides of the first barrier rib 7*a* interposed therebetween, and the Y-electrodes 9 are separately formed on both sides of the second barrier rib 9*b* interposed therebetween.

The X-electrode 7 is provided between the front substrate 1 and the rear substrate 3 to have the same height (in the z-axis direction) as the first barrier rib 7*a*. The Y-electrode 9 is provided between the front substrate 7 and the rear substrate 9 to have the same height (in the z-axis direction) as the second barrier rib 9*a*.

The X- and Y-electrodes 7 and 9 are formed by applying an electrically conductive material on the first and second barrier ribs 7*a* and 9*a*, respectively, by deposition or the like, and applying a dielectric material on the electrically conductive material. Accordingly, the X-electrodes 7 are formed on both sides of the first barrier rib 9*a* and covered with the dielectric layer 21, while the Y-electrodes 9 are formed on both sides of the second barrier rib 9*a* and covered with the dielectric layer 21. As in the first embodiment, to obtain such an effect that the X- and Y-electrodes 7 and 9 are alternately arranged, the same sustain voltage should be supplied to the separated X-electrodes 7 and the same sustain voltage should be supplied to the separated Y-electrodes 9.

Figure 5:
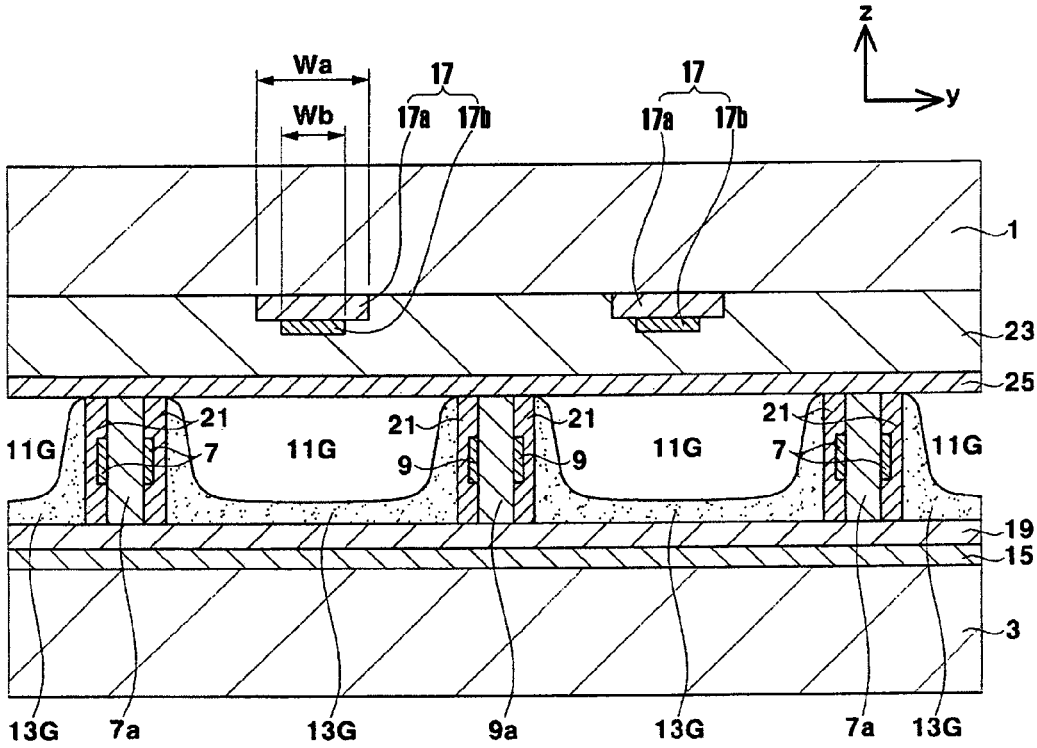
FIG. 5 is a cross-sectional view of a PDP in accordance with a third embodiment of the present invention.

FIG. 5 is a cross-sectional view of a PDP in accordance with a third embodiment of the present invention.

Referring to FIG. 5, the construction of the third embodiment is the same or similar to that of the second embodiment. Thus, only a detailed description of the different parts between the second and third embodiments is provided below.

While the X- and Y-electrodes 7 and 9 are formed to have the same height as the first and second barrier ribs 7*a* and 9*a* in the second embodiment, the X- and Y-electrodes 7 and 9 are formed to be lower in height than the first and second barrier ribs 7*a* and 9*a* in the third embodiment. The X- and Y-electrodes 7 and 9 are provided in the center of the discharge cells 11R, 11G, 11B formed between the front substrate 1 and the rear substrate 3 in a height direction (the z-axis direction) of the discharge cells. Accordingly, the X- and Y-electrodes 7 and 9, and the first and second barrier ribs 7*a* and 9*a*, which are not covered by the X- and Y-electrodes 7 and 9, are covered with the dielectric layer 21. The third embodiment exemplifies, together with the second embodiment, that the X- and Y-electrodes 7 and 9 can be implemented in various manners.

According to the above-mentioned embodiments, it is possible to prevent a short-circuit condition since the X- and Y-electrodes 7 and 9 are separately formed on both sides of the discharge cells 11R, 11G, 11B.

As is apparent from the above description, according to the present invention, a discharge cell has barrier ribs formed on its two sides and first and second electrodes (X- and Y-electrodes) formed on the other two sides. Accordingly, an opposing discharge can be generated between the first and second electrodes, thereby facilitating a discharge. Furthermore, since a third electrode (M-electrode) intersecting an address electrode in the discharge cell is formed on a front substrate, it is possible to minimize the blockage of visible light rays in a discharge area and thus to improve the discharge efficiency.

While the present invention has been described with reference to exemplary embodiments thereof, it will be understood by those skilled in the art that various modifications in form and detail can be made therein without departing from the scope of the present invention as defined by the following claims.

What is claimed is:

1. A Plasma Display Panel (PDP), comprising:

a first substrate and a second substrate arranged opposite to each other;

a plurality of barrier ribs spaced apart from each other and arranged in parallel between the first and second substrates to define first and second sides of closed discharge cells, each discharge cell having a quadrilateral polygonal shape;

first electrodes and second electrodes spaced apart from each other and arranged in parallel between the first and second substrates to extend in a direction traversing the barrier ribs to define third and fourth sides of each of the discharge cells and alternately arranged between the discharge cells consecutively defined, the first and second electrodes having the same height as the barrier ribs, and the first and second electrodes being electrically insulated from each other;

phosphor layers respectively arranged in each of the discharge cells;

address electrodes arranged on the second substrate; and third electrodes arranged on the first substrate to extend in a direction traversing the address electrodes.

2. The PDP according to claim 1, wherein the discharge cells are rectangular in shape.

3. The PDP according to claim 1, wherein the first and second electrodes are arranged to act on all of the discharge cells adjacent to one of the address electrodes in the extending direction thereof.

4. The PDP according to claim 1, wherein the first, second and third electrodes are arranged between the first and second substrates in a repeating order of first electrode—third electrode—second electrode—third electrode—first electrode.

5. The PDP according to claim 1, wherein the first and second electrodes are stripe shaped, and extend in a direction traversing the address electrodes.

6. The PDP according to claim 1, wherein the first and second electrodes each comprise a metallic material having an excellent electrical conductivity.

7. The PDP according to claim 1, wherein the first and second electrodes each have a dielectric layer on both sides thereof.

8. The PDP according to claim 7, wherein each dielectric layer is covered with a respective one of the phosphor layers.

9. The PDP according to claim 1, wherein each third electrode includes a transparent electrode arranged on the first substrate between the first and second electrodes and extending parallel to the first and second electrodes, and a bus electrode arranged on the transparent electrode and extending in the same direction as the transparent electrode.

10. The PDP according to claim 9, wherein each bus electrode has a width narrower than that of the respective transparent electrode.

11. The PDP according to claim 9, wherein each third electrode is covered with a dielectric layer and a MgO protective film.

12. The PDP according to claim 1, wherein the discharge cells are rectangular in shape;

wherein the first electrodes are separately arranged on both sides of a first barrier rib interposed therebetween; and wherein the second electrodes are separately arranged on both sides of a second barrier rib interposed therebetween.

13. The PDP according to claim 12, wherein the first electrodes are arranged between the first and second substrates to have the same height as the first barrier ribs; and wherein the second electrodes are arranged between the first and second substrates to have the same height as the second barrier ribs.

14. The PDP according to claim 13, wherein the first electrodes and second electrodes are each covered with a dielectric layer.

* * * * *